United States Patent [19]

McConnell, Jr.

[11] Patent Number: 4,756,483

[45] Date of Patent: Jul. 12, 1988

[54] JAW CRUSHER WITH MULTIPLE DRIVE MEANS

[75] Inventor: David P. McConnell, Jr., Mesa, Ariz.

[73] Assignee: Laurence U. Turley, Gilbert, Ariz.

[21] Appl. No.: 943,552

[22] Filed: Dec. 18, 1986

[51] Int. Cl.[4] ..... B02C 1/06

[52] U.S. Cl. ..... 241/101.2; 241/266

[58] Field of Search ..... 241/101.2, 264–269

[56] References Cited

U.S. PATENT DOCUMENTS

| | | | |
|---|---|---|---|
| 3,079,096 | 2/1963 | McConnell | 241/266 X |
| 4,026,481 | 5/1977 | Bodine | 241/266 |
| 4,382,560 | 5/1983 | Toole | 241/101.2 |

FOREIGN PATENT DOCUMENTS

| | | | |
|---|---|---|---|
| 563186 | 6/1977 | U.S.S.R. | 241/266 |
| 995859 | 2/1983 | U.S.S.R. | 241/266 |

*Primary Examiner*—Mark Rosenbaum

*Attorney, Agent, or Firm*—John A. Bucher

[57] ABSTRACT

Improvements are disclosed for a jaw crusher having converging and opposed jaws defining a space for passage of material to be crushed. An improved assembly for imparting oscillatory vibration to at least one jaw comprises multiple eccentric means arranged in vertically spaced apart relation and synchronously operated by split drive means for producing more uniform and consistent operation of the crusher under different load conditions. Another improvement comprises at least two eccentric masses arranged in laterally spaced apart relation on the one jaw by separate shafts which are independently mounted by separate bearings whereby the size of both the eccentric masses and bearings is proportionately reduced to permit crusher operation at increased rates of rotation. A further improvement comprises an elongated resilient member mounted on the frame structure with a reaction member connected to the one jaw and surrounding the elongated resilient member for permitting oscillatory movement of the one jaw while limiting its travel in all directions on the frame structure. Preferably, both jaws are similarly constructed and mounted on the frame structure.

16 Claims, 4 Drawing Sheets

JAW CRUSHER WITH MULTIPLE DRIVE MEANS

FIELD OF THE INVENTION

The present invention relates to rock crushing machines and more particularly to such machines wherein oscillatory vibration or motion is produced in opposed jaws by means of eccentric masses or the like.

BACKGROUND OF THE INVENTION

U.S. Pat. No. 3,079,096, entitled "Crushing Apparatus" issued Feb. 26, 1963 to David P. McConnell, father of the inventor herein. The crusher described and claimed in that patent is particularly representative of the prior art with respect to the present invention and is accordingly discussed in greater detail below. The jaw crusher of the present invention includes certain features in common with the apparatus of the above patent and also in common with a copending U.S. patent application, Ser. No. 06/943,548; filed Dec. 18, 1986 and entitled "Improved Jaw Crusher with Drop-In Jaw" invented by Laurence U. Turly and David P. McConnell, also the inventor herein.

Accordingly, both U.S. Pat. No. 3,079,096 and the copending application referred to above are incorporated herein as though set forth in their entirety in order to provide a more complete understanding of the present invention, particularly as to common crushing apparatus features.

The crushing apparatus of the present invention also includes certain features in common with apparatus disclosed in another copending U.S. patent application, Ser. No. 06/823,309; filed Jan. 28, 1986 by David P. McConnell, the inventor herein, entitled "Jaw Crushing Apparatus" and now assigned to the assignee of the present invention. Accordingly, that copending and commonly owned reference is also incorporated herein as though set forth in its entirety.

Referring now to the incorporated references, U.S. Pat. No. 3,079,096 disclosed a jaw crusher of the type generally referred to above wherein an eccentric mass was supported for rotation behind each of its opposed jaws. Substantial forces acting upon the jaws were absorbed by resilient means including wheels with pneumatic tires arranged in shoes or cylindrical tracks partially surrounding the tires. In addition to absorbing tremendous shock loading on the jaws, the resilient tires permitted the jaws to move away from each other as necessary when uncrushable material formed, for example, from hardened steel or the like, entered between the jaws.

Accordingly, the jaw crusher of the reference was particularly effective in crushing materials such as rock while preventing the jaws or other portions of the crusher from being damaged by uncrushable material passing between the jaws.

Other jaw crushers including vibratory jaw crushers with opposed jaws operated by rotating eccentric masses have also been disclosed in the prior art. For example, reference is made to U.S. Pat. No. 1,247,701 issued Nov. 27, 1917 to Michaelsen. However, at least for purposes of the present invention, these other prior art jaw crushers are believed to be generally equivalent to that of the above incorporated reference.

Although the prior art jaw crushers discussed above were very effective for their purpose, it has been found desirable to further improve their design for further enhancing jaw crusher operation in a variety of applications. Particularly in connection with large size crushers adapted for crushing large rocks or the like, some difficulty has been found in assuring uniform transmission of oscillatory motion to different parts of the jaws. For example, when large rocks are the like which are difficult to crush are trapped between certain portions of the opposed jaws, vibratory forces applied to the jaws follow the path of least resistance so that the jaws tend to experience increased vibratory movement at a location away from the large rock. This tendency naturally interferes with rapid and efficient crusher operation.

In addition, difficulty has also been encountered in assuring uniform transmission of vibratory motion to jaws of increased size. This is true both for jaws of extended or increased lateral dimension, for example, to achieve increased throat size, or increased longitudinal dimension, for example where a longer, more gradual nip is desired between the jaws.

It has also been noted that, particularly with larger crushers, assembly and disassembly is made more difficult. This is most noticeable in connection with the jaws themselves which tend to experience concentrated wear during operation of the crusher.

Accordingly, there has been found to remain a need for a jaw crusher exhibiting improvements in the areas discussed above as well as in other areas.

SUMMARY OF THE INVENTION

It is therefore an object of the present invention to provide an improved jaw crusher capable of overcoming one or more of the disadvantages discussed above.

It is a further object of the invention to provide a jaw crusher having opposed jaws with at least one of the jaws being supported in floating relation on a supporting frame structure, improved means for imparting oscillatory vibration to the one jaw comprising multiple eccentric means arranged in vertically spaced apart relation on the one jaw in order to impart oscillatory vibration to respective portions of the one jaw for producing more uniform and consistent operation of the crusher under different load conditions, split drive means synchronously operating the multiple eccentric means.

It is a further object of the invention to provide such a crusher with opposed jaws wherein at least two eccentric masses are arranged on separate shafts in laterally spaced apart relation, the separate shafts being independently mounted on bearing means and interconnected by flexible coupling means.

The two arrangements referred to above can of course be incorporated in a single jaw crusher wherein vertically spaced apart eccentric means each comprise at least two eccentric masses arranged on separate shafts independently attached to the jaw by bearing means. In a crusher including either or both laterally spaced eccentric masses and/or vertically spaced eccentric masses, it has been found that vibratory motion can be more effectively and uniformly introduced into different portions of the jaw, particularly where the jaws are of relatively large size. At the same time, with the size of the eccentric masses being proportionately reduced relative to a single eccentric mass for driving the jaw, the size of the bearings supporting the multiple eccentric masses is similarly reduced. Since the size of the bearings tends to limit the rate of rotation possible for the eccentric masses, it is immediately apparent that the arrangements contemplated by the present invention are capable of permitting operation at increased rates of speed as may be desired for achieving optimum pressure operation.

It is yet another object of the invention to provide such a jaw crusher for facilitating installation and removal of either or both jaws wherein the jaw is formed with a reaction member either integrally formed with the jaw or connected thereto, the reaction member surrounding an elongated resilient member attached to the supporting frame structure. With this arrangement, the single elongated resilient member serves to permit oscillatory movement of the jaw in response to the eccentric means while at the same time limiting travel of the jaw in all directions on the frame structure. This arrangement is also particularly advantageous in avoiding multiple restraints for the jaw which tend to work against each other, for example, and absorb part of the vibratory force developed by the rotating eccentric means. Thus, with such a design, a greater portion of the vibratory force can be transferred through the jaw faces to the material to be crushed for increased efficiency.

In a preferred design, the reaction member surrounding the elongated resilient member is preferably attached to a lower portion of the jaw with additional resilient means being mounted on the frame structure behind an upper portion of the jaw. As will be disclosed in greater detail below, such an arrangement particularly facilitates installation and removal of the jaw as a unit from the crusher.

Additional objects and advantages of the invention are made apparent in the following description having reference to the accompanying drawings.

DESCRIPTION OF THE PREFERRED EMBODIMENT

Figure 1:
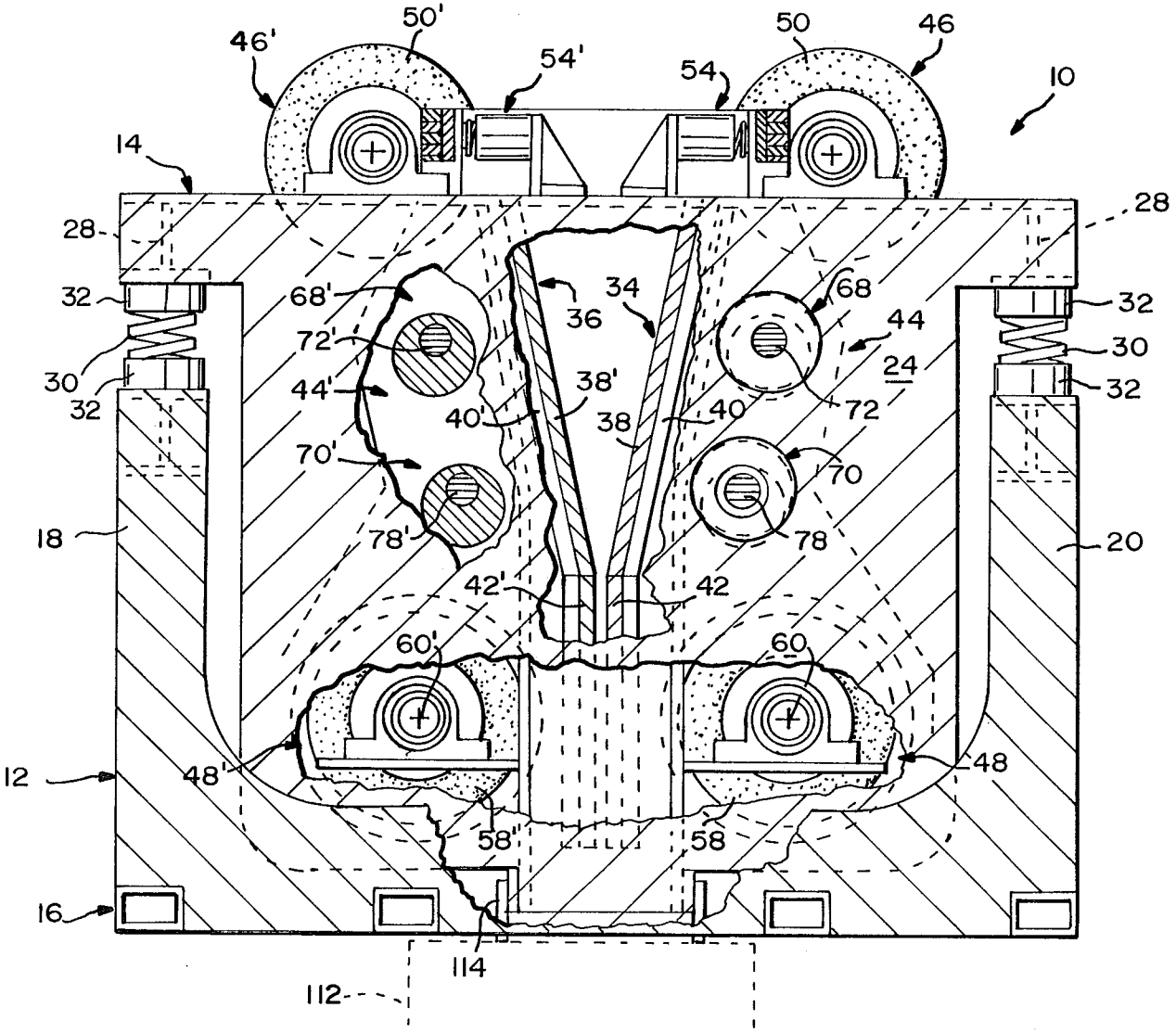
FIG. 1 is a side view, with parts removed and other parts shown in cross section, to more clearly illustrate the construction of a jaw crusher according to the present invention.

A jaw crusher constructed according to the present invention is generally indicated at 10 in the drawings and includes a base frame assembly 12 and a fabricated floating frame structure or jaw carriage frame 14. The base frame assembly 12 includes a platform 16 with upright frame members 18 and 20. Both the base frame assembly 12 and jaw carriage frame 14 are substantially reinforced as illustrated.

The jaw carriage frame 14 includes opposed upright side plates 24 and 26 which are rigidly interconnected by cross members 28.

The jaw carriage frame or floating frame assembly 14 is resiliently supported upon the base frame 12 by a plurality of coiled springs 30 interposed between the upright frame members 18 and 20 of the base frame 12 and the cross members 28 of the floating frame assembly 14. The springs 30 are positioned relative to both the upright frame members 18 and 20 and the cross members 28 by means of positioning cups 32.

A pair of pressure jaws 34 and 36 are mounted on the jaw carriage frame 14 in a manner described in greater detail below for allowing oscillatory or vibratory movement of the jaws in synchronized relation with each other. The mounting of the jaws 34 and 36 upon the floating frame assembly 14 is of particular importance because of the very substantial shock forces acting upon the jaws during operation of the crusher.

In any event, it will be more apparent from the following description that, in their oscillatory or vibratory movement, the jaws experience an upward stroke where they move upwardly and away from each other followed by a downward stroke where the jaws move downwardly and toward each other. The upward and downward strokes of the jaws produce vibratory and oscillatory movement in order to develop crushing force on rocks or other material passing between the jaws.

As noted above, the crusher jaws 34 and 36 are of substantially similar construction and are formed as mirror images to each other. Accordingly, the following description for the crusher jaw 34 also applies to the crusher jaw 36 with similar primed numerical labels being employed. However, it is to be noted that one of the jaws, for example that indicated at 36, could be relatively fixed upon the jaw carriage frame 14 with oscillatory or vibratory movement between the jaws being produced by movement of the one jaw 34 by itself. In any event, similar operation of both jaws is generally preferred in order to achieve greater crushing forces.

The jaw crusher 10 as described above generally conforms with at least one embodiment in the copending references. Similar numerical labels have also been employed to further facilitate comparison. However, it is to be noted that there are otherwise substantial differences in the manner in which the jaws and other portions of the crusher are constructed and supported for enhancing crusher operation.

Figure 4:
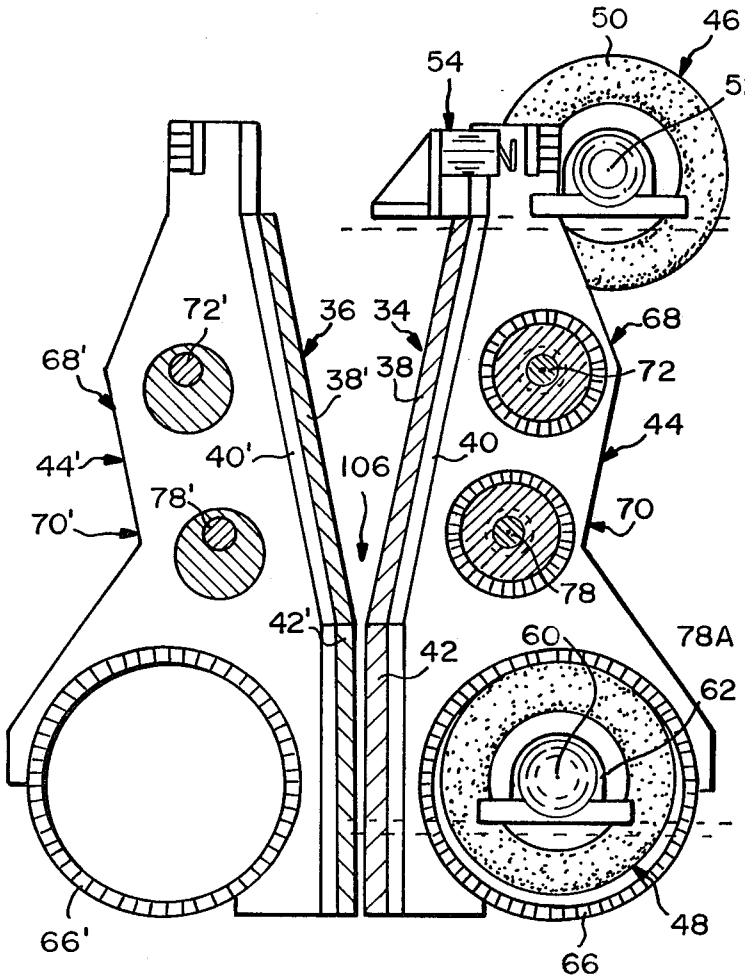
FIG. 4 is a fragmentary side view of the opposed jaws in the crusher to better illustrate their unitary construction and configuration, one of the opposed jaws being illustrated with resilient means for limiting oscillatory movement of the jaw.

Referring now particularly to FIGS. 1 and 4, the crusher jaws 34 and 36 are formed with upper hardened face plates 38 and 38' and lower hardened face plates 42 and 42' respectively. The lower face plates are substantially shorter in vertical dimension that the upper face plates. Although not a particular feature in connection with the present invention, it is noted that the upper and lower plates are preferably formed from very hard metal and secured to a backing plate 40 or 40' by means of countersunk bolts or studs (not shown) in order to facilitate removal or replacement of the facing portions of the jaws which are particularly susceptible to wear.

Referring to the unitary jaws as illustrated in FIGS. 1 and 4, the angular relationship between the upper and lower face plates 38, 42 and 38', 42' is of particular importance within the present invention in order to achieve more effective crushing action on rock or other material passing between the jaws. Generally, it is desirable for the lower face plates 42 and 42' to be substantially parallel with each other, for example, when fine crushing is desired within the apparatus 10. At the same time, it has been found desirable to form a converging angle between the upper face plates 38 and 38' for a number of reasons discussed at greater length in the incorporated copending reference noted above.

In any event, it is to be kept in mind in connection with the present invention that the multiple drive means provided by the present invention facilitates not only construction of jaws having greater lateral dimensions but also jaws having greater vertical dimensions. The greater vertical dimensions for the jaws permit, for example, formation of a longer tapered throat between the upper face plates of the two jaws.

Within a jaw crusher as described above, there are three particular areas of construction which are of importance in connection with the present invention. These three features include (1) novel upper and lower resilient elements 46 and 48 for positioning the jaw 34, (2) a multiple eccentric drive assembly generally indicated at 44 in FIG. 5 and (3) construction of the jaws 34 and 36 and associated elements of the crusher as described in greater detail below for facilitating assembly and disassembly of the jaws 34 and 36 in unitary fashion from the crusher 10. These elements are described in greater detail below.

Initially, the upper and lower elongated resilient elements 46 and 48 allow response of the jaws to the rotating eccentric masses for producing the desired oscillatory movement of the jaws. In addition, the resilient elements 46 and 48 limit travel of the jaws in a manner described in greater detail below.

The upper elongated resilient element 46 is formed by multiple members or tires 50 which are both resilient and compressible. The tires 50 are mounted on a single shaft or axle 52 which is supported at its opposite ends by bearing mounts 54 and 56 which are adjustable on the jaw carriage frame 14 for varying the distance or throat formed between the jaws 34 and 36.

The lower elongated resilient element 48 is similarly formed by tires 58 mounted on a single shaft or axle 60 which is supported at its opposite ends by bearing mounts or pillow blocks 62 and 64. The pillow blocks 62 and 64 are similarly adjustable on a lower portion of the jaw carriage frame 14 while also being detachable from the frame 14 in order to facilitate assembly and disassembly of the jaw 34 from the crusher 10 in unitary fashion as described in greater detail below.

The jaw 34 is formed with a reaction member 66 in the form of a rigid shoe or cylindrical track which entirely surrounds the tires 58. In this manner, the reaction member 66 serves to interact with the tires 58 for limiting travel of the jaw 34 in all directions during operation of the crusher. Because of the construction of the reaction member 66, the upper tires 50 act directly against the jaw itself since they do not serve a function of limiting the stroke or travel of the jaw.

Thus, the construction of the jaw is unitary to facilitate its being installed or removed from the crusher. At the same time, since travel of the jaw in all directions is limited only by the reaction member 66, the design of the jaw further avoids interference which might occur if a further reaction member (not shown or employed in the invention) were necessary. Such an arrangement of upper and lower reaction members is illustrated in the copending reference. By comparison, the design of the present jaw avoids interference between such members which might tend to absorb or neutralize a portion of the oscillatory or vibratory force otherwise being transferred to the jaw faces.

Figure 5:
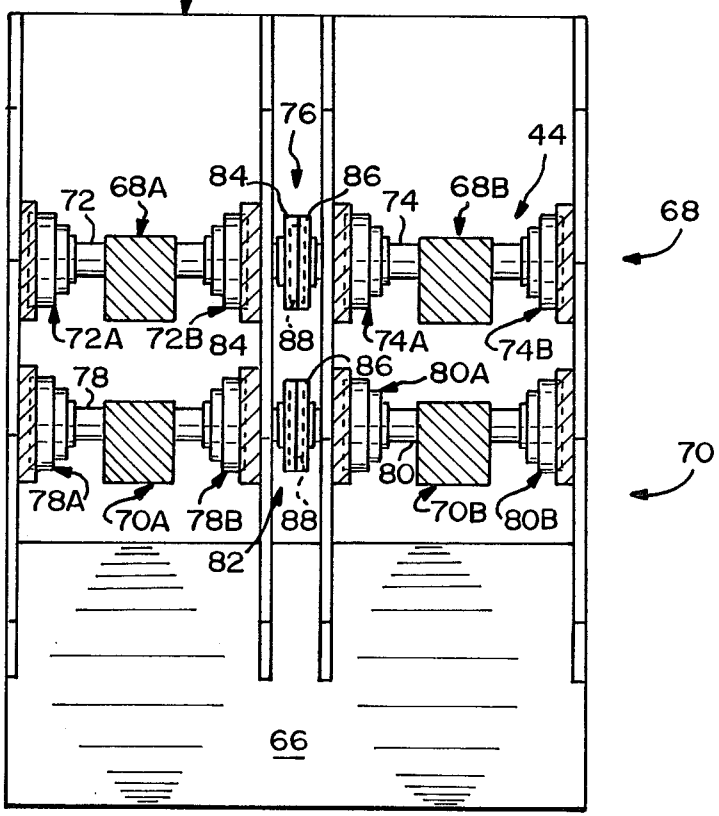
FIG. 5 is a further view of one of the jaws, taken for example from the right side of FIG. 4, with the resilient means being removed.

Before completing the description of the unitary jaw and the manner in which it can be assembled or disassembled from the crusher, the construction of the multiple eccentric drive assembly 44 is first described. Referring particularly to FIG. 5, each jaw, particularly that indicated at 34, is provided with multiple sets of eccentric means generally indicated at 68 and 70. The eccentric means 68 and 70 which are vertically spaced apart upon the jaw 34 each include laterally arranged eccentric masses 68A, 68B and 70A, 70B so that four uniformly sized eccentric masses are arranged both laterally and vertically upon the jaw 34 to facilitate more uniform transmission of oscillatory motion to all portions of the jaw.

Furthermore, the upper eccentric masses 68A and 68B are arranged on separate shafts 72 and 74 which are interconnected by a flexible drive coupling 76 while being independently coupled with the jaw 34 through separate bearing mounts 72A, 72B and 74A, 74B. The lower eccentric masses 70A and 70B are similarly mounted on separate shafts 78 and 80 which are also interconnected by means of a flexible drive coupling 82 and supported upon the jaw 34 by independent bearing mounts 78A, 78B and 80A, 80B.

In addition to being laterally and vertically arranged upon the jaw for more uniform transmission of force to the jaw, this arrangement permits a number of advantages in the invention. Initially, with the laterally spaced eccentric masses being arranged on separate shafts, there is no problem of maintaining alignment between the two eccentric masses. Also, with the four eccentric masses 68A, 68B and 70A, 70B replacing a single eccentric mass, the independent bearings for the various eccentric masses can be of substantially reduced size and diameter. This in turn permits operation of the eccentric masses at higher rates of rotation, at least partly because of the reduced mass in the bearings. Still further, the reduced size of the eccentric masses permits them to be arranged closer to the face 38 of the jaw so that oscillatory motion is more effectively transferred to the jaw face at least partly because of the reduced moment arm between the jaw face and the eccentric masses.

Each of the flexible drive couplings 76 and 82 is of generally conventional construction for coupling the respective shafts 72, 74 and 78, 80 while allowing them to be independently supported by their respective bearings. For example, referring particularly to FIG. 5, the flexible drive couplings 76 and 82 are each formed by members 84 and 86 which are respectively coupled with the shaft 72 and 74 or 78 and 80 while being coupled for rotation with each other by means of an internal spider 88.

Figure 2:
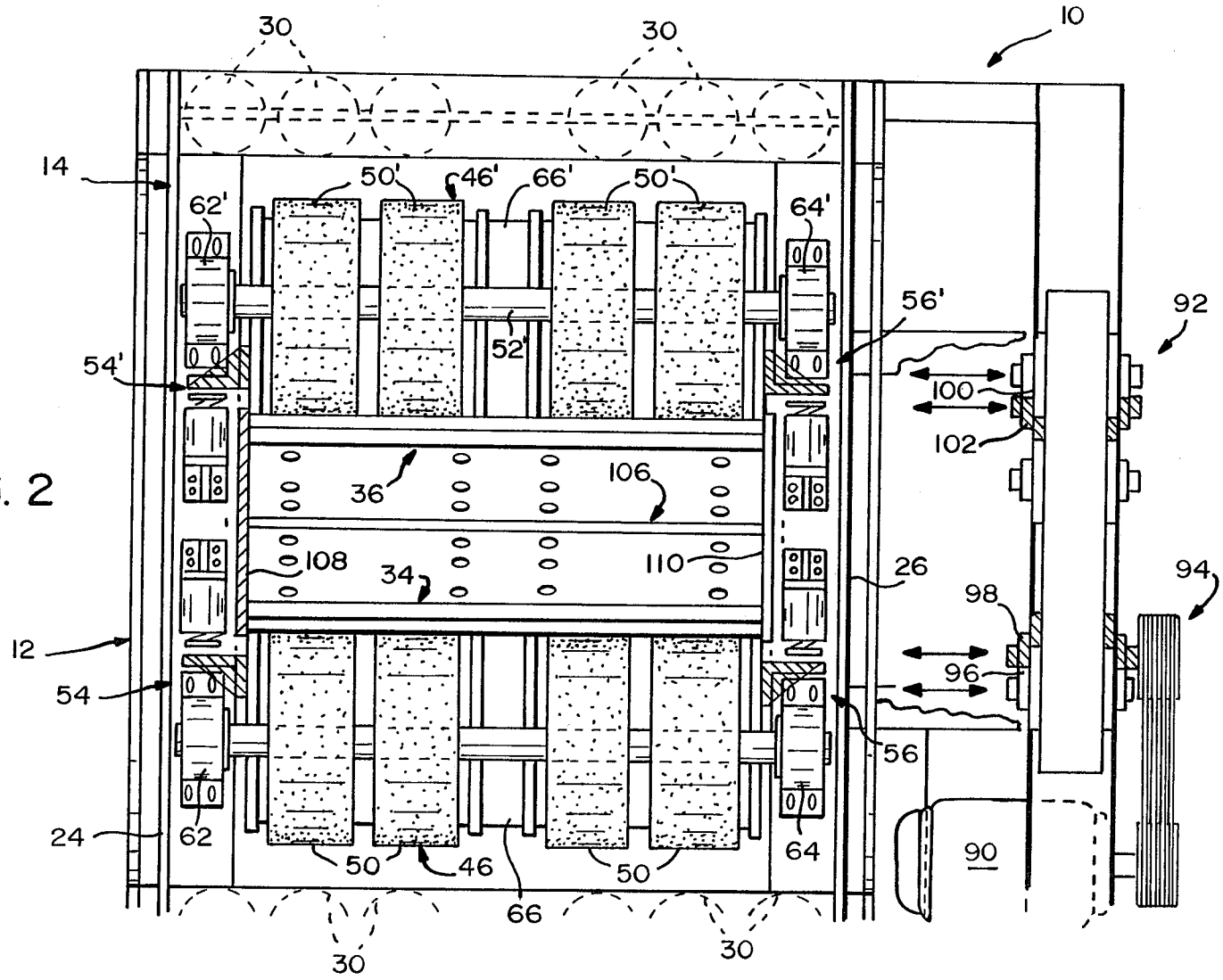
FIG. 2 is a plan view of the crusher taken generally from the top of FIG. 1, the jaw crusher of FIG. 2 including a base structure and drive assembly which are omitted in FIG. 1 for greater clarity.
Figure 3:
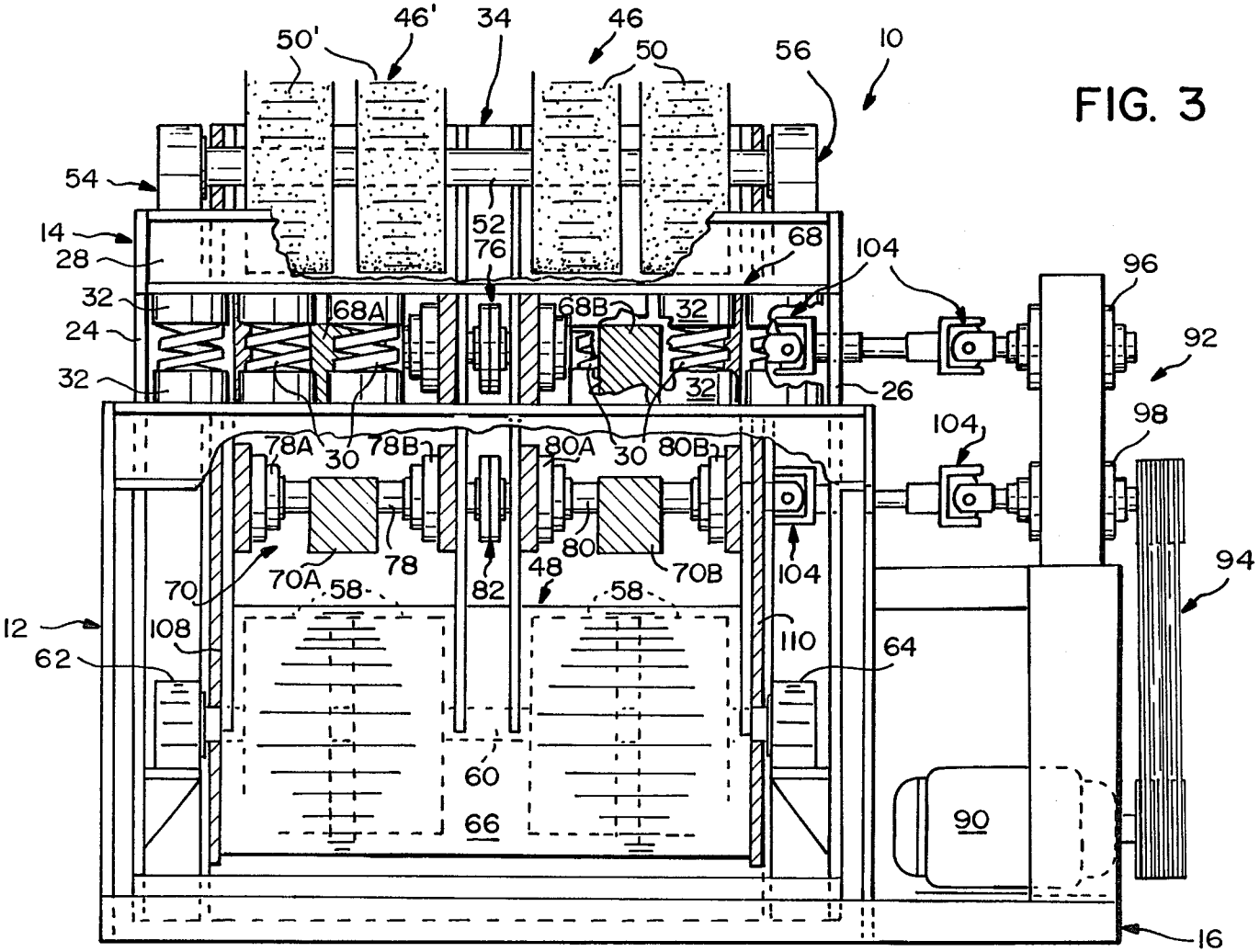
FIG. 3 is an end view of the crusher taken generally from the right side of FIG. 1.

Referring also to FIGS. 2 and 3, all of the eccentric masses for both jaws 34 and 36 are operated by a single drive motor 90 which is coupled with both the upper and lower eccentric means 68 and 70 by a split drive train generally indicated at 92. The motor 90 is connected with the split drive train 92 through drive belts generally indicated at 94. The split drive train 92 itself comprises drive gears 96, 98, 100 and 102 which are interconnected respectively with the upper and lower eccentric means for each of the jaws 34 and 36.

Referring particularly to FIG. 3, the respective drive gears are interconnected with the upper and lower eccentric means 68, 70 and 68', 70' for the jaws 34 and 36 by means of universal couplings all indicated at 104. The universal couplings 104 further avoid possibilities of misalignment while also providing means for uncoupling the eccentric means from the drive train to facilitate removal and installation of the jaws in unitary fashion.

Referring again to the construction of the upper and lower elongated resilient elements 46 and 48, the pillow blocks 62 and 64 can be simply disconnected from the jaw carriage frame 14 to permit the lower tires 58 and shaft 60 to remain within the reaction member 66 so that they form part of the unitary jaw during assembly and disassembly. Furthermore, with the pillow blocks 62 and 64 being disconnected, the lower end of the jaw 34, as viewed for example in FIG. 1, can be shifted outwardly or to the right so that the upper end of the jaw 34 drops out of engagement with the upper elongated resilient element 46. Thereafter, the entire unitary jaw 34 can simply be moved away from the crusher 10 for repairs or replacement as desired. Similarly, the unitary construction of the jaw 36 permits it to be assembled or disassembled from the crusher 10 in the same manner.

In addition to facilitating removal and installation of the jaws 34 and 36, these features of the crusher 10 also permit the overall height of the crusher 10 to be reduced not only to minimize the need for head room but also to lower the center of gravity for the crusher. The need for available overhead space is further reduced because of the ability to remove and install the unitary jaws 34 and 36 in the manner described above. Still further, in addition to reducing the overall height of the crusher 10, the throat area 106 formed between the jaws 34 and 36 and by the lateral liners 108 and 110 mounted on the jaw carriage frame 14 to extend further downwardly so that they terminate closely adjacent a hopper or other container 112 for receiving crushed rock or other material from the crusher. The generation of dust can be further reduced by arranging a shroud 114 around the lower end of the throat area 106 so that the shroud 114 extends downwardly toward the hopper 112.

Accordingly, there has been disclosed a novel and improved jaw crusher offering a number of advantages as described in detail above. Numerous modifications and variations are possible in addition to those specifically described above. Accordingly, the scope of the present invention is defined only by the following appended claims.

What is claimed is:

1. An improved jaw crusher including a supporting frame structure, a pair of opposed downwardly converging crusher jaws defining therebetween a space for passage of material to be crushed, means supporting one of the jaws in floating relation on the frame structure, means supporting the other jaw on the frame structure for opposed crushing action relative to the one jaw, and improved means for imparting oscillatory vibration to the one jaw comprising multiple eccentric means arranged in vertically spaced apart relation on the one jaw for imparting oscillatory vibration to respective portions of the jaw and producing more uniform and consistent operation of the crusher under different load conditions, and split drive means for synchronously operating the multiple eccentric means, each vertically spaced eccentric means comprising at least two eccentric masses arranged on separate shafts in laterally spaced apart relation, the separate shafts being independently mounted on bearing means and interconnected by flexible coupling means, the split drive means being coupled with the shafts for driving the eccentric means in rotation.

2. The improved jaw crusher of claim 1 wherein the split drive means is coupled with one shaft in each eccentric means.

3. The improved jaw crusher of claim 2 wherein the other jaw is similarly supported as the one jaw and provided with similar multiple eccentric means, the split drive means being coupled with the multiple eccentric means on both jaws.

4. The improved jaw crusher of claim 1 wherein the means supporting the one jaw comprises an elongated resilient member connected with the frame structure behind the jaw, a reaction member connected to the one jaw and surrounding the elongated resilient member for permitting oscillatory movement of the jaw in response to the eccentric means while at the same time limiting travel of the one jaw in all directions on the frame structure.

5. The improved jaw crusher of claim 4 wherein the reaction member is connected to a lower portion of the jaw and further comprising additional resilient means mounted on the frame structure behind an upper portion of the one jaw, releasable means connecting the elongated resilient member with the frame structure and permitting the elongated resilient member to be disconnected from the frame structure to facilitate installation and removal of the jaw as a unit.

6. The improved jaw crusher of claim 5 further comprising motor means mounted on the frame structure and interconnected with the eccentric means by the split drive means and releasable coupling means allowing the eccentric means to be installed and removed as part of the jaw unit.

7. An improved jaw crusher including a supporting frame structure, a pair of opposed downwarding converging crusher jaws defining therebetween a space for passage of material to be crushed, means supporting one of the jaws in floating relation on the frame structure, means supporting the other jaw on the frame structure for opposed crushing action relative to the one jaw, and improved means for imparting oscillatory vibration to the one jaw comprising multiple sets of similar eccentric masses arranged in vertically spaced apart relation, each set having at least two eccentric masses arranged in laterally spaced apart relation on separate shafts independently mounted on the one jaw by separate bearing means, the shafts for each set of eccentric masses being interconnected by flexible coupling means, and drive means operatively interconnected with the eccentric masses for driving them in rotation and imparting oscillatory vibration to the one jaw whereby the size of the eccentric masses is proportionately reduced relative to a single eccentric mass for driving the one jaw and the size of the bearings is similarly reduced permitting operation of the eccentric masses at increased rates of rotation as desired for achieving optimum operation of the crusher, one of the shafts for each set of eccentric masses being interconnected with the drive means by split gear means for synchronously operating the multiple sets of eccentric masses.

8. The improved jaw crusher of claim 7 wherein the other jaw is similarly supported as the one jaw and provided with similar laterally spaced apart eccentric masses, the drive means being operatively interconnected with the laterally spaced apart eccentric masses on both jaws.

9. The improved jaw crusher of claim 8 wherein the means supporting each jaw comprises an elongated resilient member connected with the frame structure behind the jaw, a reaction member connected to the jaw and surrounding the elongated resilient member for permitting oscillatory movement of the jaw in response to the eccentric masses while at the same time limiting travel of the jaw in all directions on the frame structure.

10. The improved jaw crusher of claim 9 wherein the reaction member is connected to a lower portion of the jaw and further comprising additional resilient means mounted on the frame structure behind an upper portion of the jaw, releasable means connecting the elongated resilient member with the frame structure and permitting the elongated resilient member to be disconnected from the frame structure to facilitate installation and removal of the jaw as a unit.

11. The improved jaw crusher of claim 10 further comprising motor means mounted on the frame structure and interconnected with the eccentric masses by the split drive means and releasable coupling means allowing the eccentric masses to be installed and removed as part of the jaw unit.

12. The improved jaw crusher of claim 7 wherein the means supporting the one jaw comprises an elongated resilient member connected with the frame structure behind the one jaw, a reaction member connected to the one jaw and surrounding the elongated resilient member for permitting oscillatory movement of the one jaw in response to the eccentric masses while at the same time limiting travel of the jaw in all directions on the frame structure, the reaction member being connected to a lower portion of the one jaw and further comprising additional resilient means mounted on the frame structure behind an upper portion of the one jaw, releasable means connecting the elongated resilient member with the frame structure and permitting the elongated resilient member to be disconnected from the frame structure to facilitate installation and removal of the one jaw as a unit.

13. The improved jaw crusher of claim 12 further comprising motor means mounted on the frame structure and interconnected with the eccentric masses by the split drive means and releasable coupling means allowing the eccentric masses to be installed and removed as part of the jaw unit.

14. In a jaw crusher including a supporting frame structure, a pair of opposed downwardly converging crusher jaws defining therebetween a space for passage of material, means supporting one of the jaws in floating relation on the frame structure, means supporting the other jaw on the frame structure for opposed crushing action relative to the one jaw, an improved support for the one jaw comprising an elongated resilient member connected with the frame structure behind the jaw, a reaction member connected to the jaw and cicumferentially surrounding the elongated resilient member for permitting oscillatory movement of the jaw in response to an eccentric means while at the same time limiting travel of the jaw in all directions on the frame structure, the reaction member being connected to a lower portion of the jaw and further comprising additional resilient means mounted on the frame structure behind an upper portion of the jaw, releasable means connecting the elongated resilient member with the frame structure and permitting the elongated resilient member to be disconnected from the frame structure to facilitate installation and removal of the jaw as a unit, and motor means mounted on the frame structure and interconnected with the eccentric means by releasable coupling means allowing the eccentric means to be installed and removed as part of the jaw unit.

15. The improved jaw crusher of claim 14 wherein the other jaw is similarly supported as the one jaw and provided with a similar improved support.

16. The improved jaw crusher of claim 14 further comprising retainer means mounted on the frame structure for preventing an upper end of the one jaw from collapsing inwardly toward the other jaw particularly when the upper end of the crusher is empty of material to be crushed, the retainer means being further adapted to facilitate installation and removal of the jaw as a unit.

* * * * *